United States Patent [19]

Braid et al.

[11] 4,101,430

[45] Jul. 18, 1978

[54] LUBRICANT COMPOSITIONS

[75] Inventors: Milton Braid, Westmont; Samuel J. Leonardi, Pitman, both of N.J.

[73] Assignee: Mobil Oil Corporation, New York, N.Y.

[21] Appl. No.: 768,925

[22] Filed: Feb. 15, 1977

[51] Int. Cl.[2] ..... C10M 1/54; C10M 3/48; C10M 5/28; C10M 7/52

[52] U.S. Cl. ..... 252/42.7; 252/75; 252/400 R

[58] Field of Search ..... 252/42.7, 400 R, 75

[56] References Cited

U.S. PATENT DOCUMENTS

| | | | |
|---|---|---|---|
| 2,971,941 | 2/1961 | Fuchman et al. | 260/439 R |
| 3,398,170 | 8/1968 | Cyba | 252/400 R |
| 3,557,225 | 1/1971 | Kubicek | 252/400 R |
| 3,636,022 | 1/1972 | Bright | 252/400 R |
| 3,692,738 | 9/1972 | Mathis et al. | 252/400 R |
| 3,816,492 | 6/1974 | Stretanski et al. | 252/400 R |

*Primary Examiner*—Delbert E. Gantz
*Assistant Examiner*—Irving Vaughn
*Attorney, Agent, or Firm*—Charles A. Huggett; Raymond W. Barclay; Howard M. Flournoy

[57] ABSTRACT

Lubricant compositions are provided containing a stabilizing amount against oxidative degradation of an organo sulfur-containing nickel complex.

14 Claims, No Drawings

LUBRICANT COMPOSITIONS

BACKGROUND OF THE INVENTION

1. Field of the Invention

This invention relates to lubricant compositions, and relates more particularly to lubricant compositions normally subject to oxidative degradation. The invention relates to lubricant compositions, such as oils of lubricating viscosity, hydrocracked lubricating oils, hydraulic oils, mineral oils or fractions thereof, automotive oils, gear oils, transmission fluids, waxes, greases and other forms of lubricants normally requiring the presence of stabilizing agents against oxidative degradation which may be catalyzed by ultra-violet light or the presence of metals, or which may occur during high temperature conditions.

2. Description of the Prior Art

In general, the production of lubricant compositions, for example, lubricating oils produced by hydrocracking affords a relatively high viscosity index and permits the use of certain stocks that would be unsuitable for other processes. On the other hand, however, hydrocracked lubricating oils tend toward poor stability against ultra-violet light degradation, rapidly forming suspended and/or precipitated insoluble material on exposure to ultra-violet light, such as sunlight, or other sources of actinic radiation. Compounds capable of absorbing ultra-violet light, for example, hydroxybenzophenones, and hydroxyphenyl benzotriazoles, have afforded some improvement in the light stability of hydrocracked oils. Conventional antioxidants have also provided some benefit.

In the literature, Heskins and Guillet in "Mechanism of Ultraviolet Stabilization of Polymers", Macromolecules 1, 97 (1968) first proposed the energy transfer mechanism of ultra-violet protection. Commercially available ultra-violet stabilizers are also listed by class and function and identified as to structure in the Kirk-Othmer Encyclopedia in "Encyclopedia of Chemical Technology"; Second Edition, Vol. 21, pp. 115–122. Uri in "Thermal and Photochemical Oxidation of Polymers and Its Prevention", Chemistry and Industry, Mar. 1, 1975, pp. 199–203, cites conventional antioxidant effects (hydroperoxide decomposition and free radical capture) of bis(stilbenedithiolato)nickel and its ultra-violet inhibiting properties. In British Patent Specification No. 1,263,910 (1972), there is disclosed bis(stilbenedithiolato)nickel as an antioxidant for plastic materials. The specification also cites superior hydroperoxide decomposition capability of this additive. U.S. Pat. No. 3,832,304, discloses the use of aromatic azo compounds for stabilizing hydrocracked oils. None of the foregoing disclosures show lubricant compositions containing the organo sulfur-containing nickel complexes described herein.

SUMMARY OF THE INVENTION

In accordance with the present invention, we have found that oxidative degradation of lubricant compositions for example by ultra-violet light, present in sunlight or other sources of actinic radiation, can be effectively inhibited by the incorporation of organo sulfur-containing nickel complexes in the lubricant compositions. These nickel complexes are particularly effective against oxidative degradation in lubricating media such as oils of lubricating viscosity, hydrocracked lubricating oils, hydraulic oils, mineral oils or fractions thereof, automotive oils, gear oils, transmission fluids, waxes, greases and other forms of lubricant compositions normally requiring the presence of stabilizing agents against oxidative degradation.

The organo sulfur-containing nickel complexes can be effectively employed in any amount which is sufficient for imparting to the lubricant the desired degree of protection against oxidative degradation. In many instances, the nickel complex is effectively employed in an amount from about 0.01 to about 5%, by weight, and preferably in an amount from about 0.1 to about 2%, by weight, of the total weight of the lubricant composition. The term "nickel complex", as used herein is intended to include nickel compounds having a chelate ring formation. As hereinbefore indicated, the organic sulfur-containing nickel complexes may be incorporated in any lubricating media which can include oils of lubricating viscosity and also greases in which any of the aforementioned oils are employed as vehicles. In general, synthetic oils can also be effectively protected against oxidative degradation or may also be employed in combination with mineral oils, or as grease vehicles. Typical synthetic vehicles include polyisobutylene, polybutenes, hydrogenated polydecenes, polypropylene glycol, polyethylene glycol, trimethylol propane esters, neopentyl and pentaerythritol esters, di(2-ethyl hexyl)sebacate, di(2-ethyl hexyl)adipate, dibutyl phthalate, fluorocarbons, silicate esters, silanes, esters of phosphorus-containing acids, liquid ureas, ferrocene derivatives, hydrogenated mineral oils, chain-type polyphenols, siloxanes and silicones (polysiloxanes), alkyl-substituted diphenyl ethers typified by a butyl-substituted bis-(p-phenoxy phenyl)ether, phenoxy phenylether, etc.

The organic sulfur-containing nickel complexes in accordance with the present invention include nickel alkyl phenolate sulfides having the following structure:

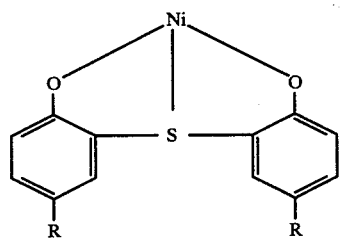

I in which R is either hydrogen or an alkyl group having from 1 to about 30 carbon atoms and preferably from 4 to about 12 carbon atoms.

Representative of the nickel phenolate sulfides is nickel 2,2'-thiobis-(4-t-octyl)phenolate having the structure:

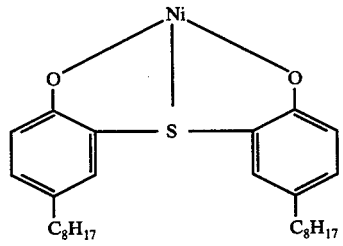

and nickel phenol sulfide having the structure:

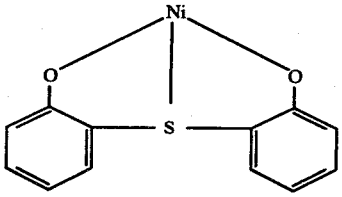

The phenolates of the invention can be conveniently prepared by known methods, see for example, U.S. Pat. No. 2,971,941; also the phenolates of the invention may be prepared by converting phenol-phenolates (see structure II below) thereto.

Phenol-phenolates having structure II below as mentioned heretofore can be converted to the phenolate (structure I) described herein above.

II

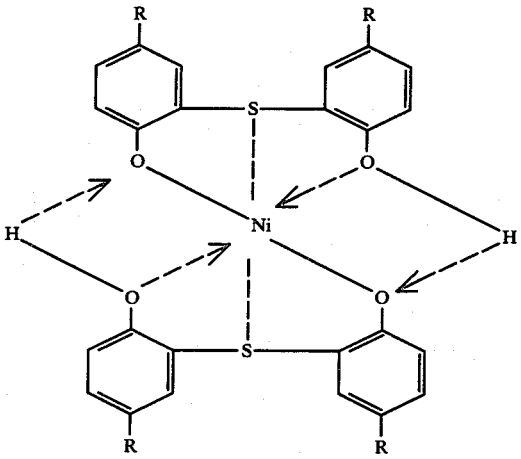

in which R is either hydrogen or an alkyl group having from 1 to about 30 carbon atoms.

Representative of the nickel phenol-phenolates is a nickel 2,2'-thiobis-(4-t-octyl)phenol-phenolate having the above structure in which R is $C_8H_{17}$.

Typically the phenol-phenolate, e.g., nickel 2,2'-thiobis-(4-t-octyl)phenol-phenolate is dissolved in a suitable solvent (e.g., ethanol, methanol, acetone, 2-propanol and the like), heated with stirring to about 80°-85° C, thereafter the hot mixture is filtered and the solid product is heated to about 180°-185° C and the phenolate (here nickel 2,2'-thiobis-(4-t-octyl)phenolate recovered.

DESCRIPTION OF SPECIFIC EMBODIMENTS

Examples 1-4 describe the base lubricant and certain conventional antioxidants tested in accordance with Tables 1 and 2.

EXAMPLE 5

To a mixture of 26 g of nickel acetate tetrahydrate in 250 ml of xylene stirred and heated at 100° C were added 100 g of the nickel phenol-phenolate of O,O'-bis-(p-1,1,3,3-tetramethylbutylphenol)monosulfide described in U.S. Pat. No. 2,971,941. The resulting mixture was heated to a temperature of 136° C during 1.5 hr and maintained there while water and acetic acid were removed by azeotropic distillation. The mixture was filtered and the solvent was removed by distillation and the residue was extracted with pentane and filtered. The solvent was thereafter removed from the filtrate and the residue heated under nitrogen at 180°-185° C for about 2 hr leaving the nickel 2,2'-thiobis-(4-t-octyl)phenolate as a greenish tan solid m.p. greater than 300° C.

EXAMPLE 6

One hundred and fifty grams of the phenol-phenolate (melting range 147-149° C) described in U.S. Pat. No. 2,971,941 and as prepared in Example 1 was added to about 1500 ml of 2-propanol and the mixture was heated and stirred. As the temperature, about 80°-85° C, approached reflux the phenol-phenolate virtually all dissolved. After about 0.25 to 0.5 hr, precipitation of solids began and the mixture became progressively more turbid. The hot mixture was filtered and the solids collected were air dried and then heated under a stream of nitrogen gas at 180°-185° C for 2.5 hr. There was obtained 65.3 of nickel 2,2'-thiobis-(4-t-octyl)phenolate as a tan colored solid melting above 300° C.

EXAMPLE 7

Nickel 2,2'-thiobis-(4-t-octyl)phenolate prepared as in Example 2 was heated while passing a stream of nitrogen gas over it at 180°-185° C for 2.5 hr. The resulting tan solids did not melt below 300° C and gave the following elemental analysis:

Anal. Calculated for $C_{28}H_{40}O_2SNi$: S, 6.40; Ni, 11.75. Found: S, 6.15; Ni, 11.0.

EXAMPLE 8

Nickel 2,2'-thiobis-(4-t-octyl)phenolate prepared as in Example 2 was subjected to heating under a stream of nitrogen gas for 0.5 hr at 180°-185° C and for about 0.25 hr at temperatures from 185°-240° C.

EXAMPLE 10

To a mixture of 19.6 g of potassium hydroxide in 500 ml of ethanol heated at 60°-70° C was added while stirring 150.7 g of the nickel phenol-phenolate of O,O'-bis(p-1,1,3,3-tetramethylbutylphenol)monosulfide described in U.S. Pat. No. 2,971,941. The mixture thickened and 200 ml of ethanol followed by 40.4 g of nickel II chloride hexahydrate in 200 ml of ethanol were then quickly added. The reaction mixture was stirred at reflux temperature for about 2.5 hr and then filtered. The solids collected were dried and extracted with pentane. The pentane was distilled from the extract and the residual solids were subjected to heating at 180°-185° C under a stream of nitrogen. The nickel 2,2'-thiobis-(4-t-octyl)phenolate obtained thus was a greenish tan solid melting above 300° C.

EXAMPLE 11

A mixture of 330 g of 2,2'-thiobis-(4-t-butyl)phenol and 247.6 g of nickel II acetate tetrahydrate in 2000 ml of xylene is heated at reflux temperature while stirring until there is no further evidence of azeotropic distillation of water or acetic acid. The xylene is removed from the extract and the residual solid is heated for 2 hr at 180°-185° C leaving the nickel 2,2'-thiobis-(4-t-butyl)-phenolate product as a tan solid.

In order to evaluate the effectiveness of the organosulfur-containing nickel complexes of the present invention against ultra-violet degradation in lubricant media, the following test was employed:

This test utilized a base oil, viz. a hydrofinished hydrocracked 100" oil obtained by dewaxing 725° F bottoms from a first-stage product of a fuel hydrocracker. Blends of additives with the aforementioned hydrocracked base oil were tested by subjecting 20 grams of the test oil in a capped 4-ounce tall form bottle to daylight on a window sill with a southeast exposure. The test oil was observed each day for suspended insoluble products, which usually progress from a haze to a suspended floc, and precipitates, which generally are preceded by hazes or flocs, and often consist of settled haze or floc. Hazes, flocs and precipitates are each rated visually, according to the quantity formed, on a scale ranging from "slight" or "trace", through "light", "medium", and "heavy". A test oil is considered to have failed, i.e., to have been significantly oxidized, when the quantity of haze, or floc, or precipitate exceeds "slight" or "trace". In Tables 1 and 2 below are recorded the results obtained employing 0.1 and 0.5 weight percent additives in the aforementioned hydrocracked base oil. From the Tables it will be noted that the nickel complexes of the present invention are markedly more effective against ultra-violet catalyzed oxidative degradation (Examples 5–8) than commercially available conventional antioxidants (Examples 2–3), and ultra-violet stabilizers of the phenol-phenolate type (Example 4).

TABLE 1

Daylight Exposure Tests of Hydrocracked Base Stock Containing 0.5 wt. % Additives

| Example | Additive | Number of Days to Failure |
|---|---|---|
| | None | 2 |
| 2 | N-Phenyl-1-naphthylamine | 3 |
| 3 | Di-t-butyl-para-cresol | 3 |
| 4 | Nickel 2,2'-thiobis-(4-t-octyl)phenol-phenolate | 23–24 |
| 5 | Nickel 2,2'-thiobis-(4-t-octyl)phenolate | 39–42 |
| 6 | Nickel 2,2'-thiobis-(4-t-octyl)phenolate | 32 |
| 8 | Nickel 2,2'-thiobis-(4-t-octyl)phenolate | 36–37 |

TABLE 2

Daylight Exposure Tests of Hydrocracked Base Stock Containing 0.1 wt. % Additives

| Example | Additive | Number of Days to Failure |
|---|---|---|
| 1 | None | 2 |
| 2 | N-Phenyl-1-naphthylamine | 3 |
| 3 | Di-t-butyl-para-cresol | 3 |
| 4 | Nickel 2,2'-thiobis-(4-t-octyl)phenol-phenolate | 7 |
| 5 | Nickel 2,2'-thiobis-(4-t-octyl)phenolate | 8 |
| 6 | Nickel 2,2'-thiobis-(4-t-octyl)phenolate | 9 |
| 8 | Nickel 2,2'-thiobis-(4-t-octyl)phenolate | 8 |

Table 3 below shows the effectiveness of a typically representative nickel complex of the present invention, as an antioxidant in ester base lubricant compositions. The representative additive was blended in a base stock comprising esters of pentaerythritol prepared as described below.

Antioxidant Evaluation

The organo-nickel complexes of this invention were tested in a catalytic oxidation test for lubricants, using as the base medium a synthetic ester lubricant. This lubricant is prepared by the esterification of technical grade pentaerythritol with a mixture of commercial monocarboxylic acids — valeric and pelargonic acids. The test lubricant composition is subjected to a stream of air which is bubbled through the composition at a rate of 5 liters per hour at 450° F for 24 hours. Present in the composition are metals commonly used as materials of engine construction, namely:

(a) 15.6 sq. in. of sand-blasted iron wire,
(b) 0.78 sq. in. of polished copper wire,
(c) 0.87 sq. in. of polished aluminum wire, and
(d) 0.167 sq. in. of polished lead surface.

Inhibitors for oil are rated on the basis of prevention of oil deterioration as measured by the increase in acid formation or neutralization number (NN) and kinematic viscosity (KV) occasioned by the oxidation. The results of the tests are reported in Table 3.

As will be noted from the table, the oxidation life of the base oil was markedly increased by the antioxidant effect imparted by the nickel complex in accordance with the present invention.

TABLE 3

Catalytic Oxidation Tests of Ester Base Stock Containing 2.0 wt. % Additives

| Example | Additive | Neutralization Number Increase | Increase in Kinematic Viscosity at 100° F, % |
|---|---|---|---|
| 9 | None | 8.25 | 586 |
| 4 | Nickel 2,2'-thiobis-(4-t-octyl)phenol-phenolate | 4.8 | 110 |
| 5 | Nickel 2,2'-thiobis-(4-t-octyl)phenolate | 3.9 | 70 |
| 7 | Nickel 2,2'-thiobis-(4-t-octyl)phenolate | 4.2 | 78 |
| 10 | Nickel 2,2'-thiobis-(4-t-octyl)phenolate | 4.2 | 88 |

While this invention has been described with reference to preferred compositions and components therefore, it will be understood by those skilled in the art that departure from the preferred embodiments can be effectively made and are within the scope of the specification.

We claim:

1. A lubricant composition comprising a major amount of a lubricant base and a minor amount effective for stabilizing said composition against oxidative degradation of an organo-nickel complex having the structure

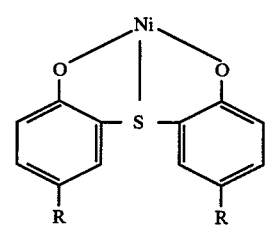

in which R is either hydrogen or an alkyl group having up to 30 carbon atoms.

2. The lubricant composition defined in claim 1 wherein the nickel complex is a nickel thiobis-alkylphenolate.

3. The lubricant composition defined in claim 2 wherein the nickel complex is nickel 2,2'-thiobis-(4-t-octyl)phenolate.

4. The lubricant composition defined in claim 1 wherein the nickel complex is present in an amount from about 0.01 to about 5%, by weight.

5. The lubricant composition defined in claim 1 wherein the nickel complex is present in an amount from about 0.1 to about 2%, by weight.

6. The lubricant composition defined in claim 1 wherein said lubricant comprises an oil of lubricating viscosity.

7. The lubricant composition defined in claim 1 wherein said lubricant comprises a hydrocracked lubricating oil.

8. The lubricant composition defined in claim 1 wherein said lubricant comprises a hydraulic oil.

9. The lubricant composition defined in claim 1 wherein said lubricant comprises a mineral oil or a fraction thereof.

10. The lubricant composition defined in claim 1 wherein said lubricant comprises a wax.

11. The lubricant composition defined in claim 1 wherein said lubricant comprises a grease.

12. The lubricant composition defined in claim 1 wherein said lubricant is a synthetic base oil.

13. The lubricant composition defined in claim 12 wherein said lubricant is an ester base oil.

14. The lubricant composition defined in claim 13 wherein said lubricant is an ester of pentaerythritol and a $C_5$–$C_9$ carboxylic acid or mixtures thereof.

* * * * *